US005975426A

United States Patent [19]

Myers

[11] Patent Number: 5,975,426

[45] Date of Patent: Nov. 2, 1999

[54] USE OF POROUS BEADS AS A TIP FOR NANO-ELECTROSPRAY

[75] Inventor: Peter Myers, Bromborough Wirral, United Kingdom

[73] Assignee: Waters Investments Limited

[21] Appl. No.: 09/078,473

[22] Filed: May 14, 1998

[51] Int. Cl.[6] ..... B05B 5/00

[52] U.S. Cl. ..... 239/3; 239/696; 239/708

[58] Field of Search ..... 239/3, 690, 696, 239/697, 698, 708, 145

[56] References Cited

U.S. PATENT DOCUMENTS 4,161,282 7/1979 Erb et al. ..... 239/8

4,566,636 1/1986 Sachar et al. ..... 239/698

5,810,265 9/1998 Cornelius et al. ..... 239/690

*Primary Examiner*—Andres Kashnikow

*Assistant Examiner*—Sean P. O'Hanlon

*Attorney, Agent, or Firm*—Brian L. Michaelis; Anthony J. Janiuk

[57] ABSTRACT

A durable electrospray needle uses a capillary having a substantially large outside diameter. Provision of a porous bead at the spray tip advantageously allows a fine electrospray to be formed without the need for finely machining a needle tip and orifice, which allows for economical construction. Further, because the bead itself may serve as the anode in an electrospray field circuit, costs associated with electrode placement are eliminated.

10 Claims, 1 Drawing Sheet

USE OF POROUS BEADS AS A TIP FOR NANO-ELECTROSPRAY

FIELD OF THE INVENTION

The present invention relates to electrospray, and more particularly to a needle tip apparatus for producing an electrospray formed from a sample solution.

BACKGROUND OF THE INVENTION

Electrospray is a known process by which small charged droplets are formed from liquid ejected from a capillary orifice, or jet. By subjecting the liquid emerging from the jet to a strong electric field, the ejected particles become charged. If the charge imposed on the liquid surface is strong enough to overcome the surface tension of the liquid, the liquid will break up into smaller particles in an attempt to disperse the charge and return to a lower energy state.

Electrospray apparatus are useful for producing very fine nebulized particles of an analyte. The liquid subjected to electrospray techniques might be, for example, a liquid stream effluent from a liquid chromatography (HPLC) separation step. This effluent is passed through an electrospray needle and subject to a strong electric field, which forms a very fine electrospray. The electrospray in this example could be subsequently analyzed by mass spectrometry (MS), which can advantageously provide molecular weight and structural information about the separated species as they emerge from the liquid chromatograph. MS is commonly used to determine molecular weight, identify chemical structures, and accurately determine the composition of mixtures. MS is becoming increasingly important in biological research to determine the structure of organic molecules based on the ion fragmentation pattern formed when sample molecules are ionized by electrospray techniques.

As an added advantage, the electrospray needle can be configured with a lumen that contains a packing material for adsorbing selected chemicals in the liquid solution before the electrospray is discharged from the spray needle. Further known configurations can include pneumatic, thermal, or ultrasonic assist, or the addition of arc suppression gases so that higher voltages can be applied during electrospray formation.

The prior art teaches several electrospray apparatus. Typically, these apparatus comprise a needle which is essentially a very fine capillary that can be as thin as 1–20 $\mu$m. The analyte is fed through the capillary and thereafter exposed to an electric field as discussed hereinabove. Needles of similar construction are also utilized in an ion spray process, which is an electrospray process in which the liquid is nebulized by a turbulent flow of gas such as nitrogen. Typically, the field strength required to produce an electrospray requires a voltage bias of about 2.0 to 2.5 kilovolts (kv), usually applied directly to the needle, or to electrodes placed on either side of the needle's orifice.

One serious drawback in prior art electrospray processes is the fragility of the electrospray needle capillary. Because the outlet of the needle is typically around 1–2 $\mu$m, the capillary is extremely sensitive to physical disruption and is subject to very easy breakage. This is particularly problematic due to the expense of the capillary. Another serious drawback resides in the fact that the opening of the capillary must be proximate to the electrodes for creating the electric field necessary for electrospray formation. The prior art devices in many instances fix the anode of the field circuit on the needle body itself, which requires the formation of the capillary or its encasement in a conductive material, for example stainless steel. Such constructions are typically expensive. The expensive nature of the construction of the electrospray needles in combination with their fragility makes replacement costs a recurring expense for users of electrospray technologies.

As illustrated in FIG. 1, a typical prior art electrospray needle apparatus 10 is depicted. The capillary needle 12 is configured with a tip 14. The needle apparatus 10 includes a plenum 16 for an incoming liquid sample, an upstream inlet 18 and a downstream liquid outlet 20 in the tip 14. The plenum 16 may be electrically conductive so that a voltage applied to the plenum will allow for the transfer of charge into the liquid stream. Alternatively another upstream electrode can be provided, or charge can be imposed on the capillary needle 12. A voltage is applied and the electrical field thereby produced is arranged to be at its highest at downstream outlet 20. The charge is generally conducted from the plenum 16 or capillary 12, to the liquid sample at the downstream outlet 20 in the tip 14 such that the charge and field at the outlet are high enough to cause the exiting liquid sample to break up into charged droplets to form the electrospray.

As illustrated, the tip 14 is formed having an outlet with a very small diameter. For nano electrospray, a 1–2 $\mu$m spraying orifice is required and flow rates of approximately 20 nL/min are not uncommon. Needle tips used for nano electrospray, tend to be even less durable and less likely to withstand handling and the rigors of use in a laboratory setting, without breaking.

SUMMARY OF THE INVENTION

The present invention provides a highly durable needle apparatus for use in an electrospray apparatus. An electric field is applied to the needle apparatus to effect flow of charge to a liquid stream emanating from a ruggedized needle tip in order to form a spray of fine, electrically charged, liquid droplets.

According to the invention, a needle is provided for use in electrospray apparatus which has a relatively wide diameter needle capillary with a porous bead located in the capillary outlet at the tip of the needle. The porous bead effects a ruggedized needle tip that is highly durable.

The needle according to the invention further provides a porous bead tip for a nano electrospray needle which is gold-plated to serve as an electrode for the electrospray formation circuit, such that greater electrical conductivity is made with the liquid passing through the porous bead.

Features of the invention include provision of a high-performance nano electrospray needle with a highly durable tip. The instant invention provides for a more durable electrospray needle by using a capillary having an outside diameter far in excess of that described by the prior art. The provision of a porous bead as the spray tip advantageously allows a fine electrospray to be formed without the need for precision machining of a needle orifice, which allows for economical construction. Further, because the bead itself may serve as the electrode in an electrospray field circuit, costs associated with electrode placement are eliminated. Durability in design also has a positive effect on the cost of manufacturing, packing, shipping, and storage of the needle according to the invention. The porosity of the bead at the spray tip provides multiple nanospray orifices that are collectively less prone to blockage than a single microtip, providing a more reliable source of continuous spray.

BRIEF DESCRIPTION OF THE DRAWINGS

These and other features and advantages of the present invention will become more apparent in view of the following detailed description in conjunction with the accompanying drawing, of which.

DETAILED DESCRIPTION OF AN ILLUSTRATIVE EMBODIMENT

Figure 1:
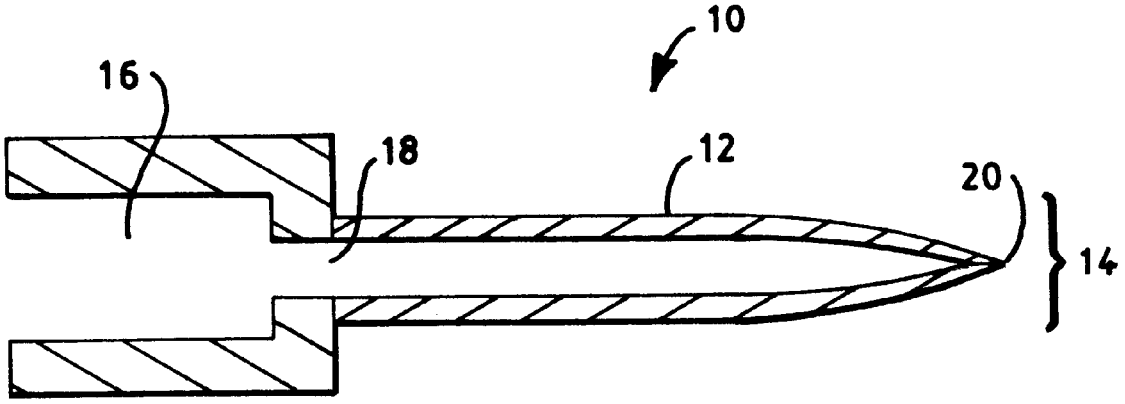
FIG. 1 (PRIOR ART)
FIG. 1 is a depiction of the prior art electrospray needle.
Figure 2:
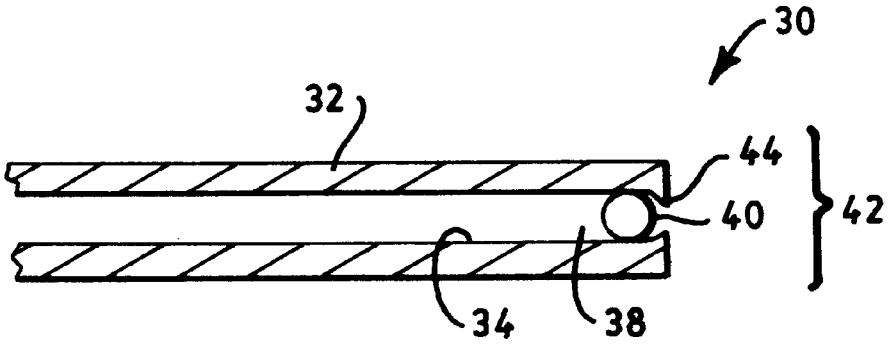
FIG. 2 is an elevation view in cross section of a first embodiment of an illustrative embodiment of the instant invention.

The present invention is described herein with reference to an illustrative embodiment of a nano electrospray needle employing a porous bead. As depicted in FIG. 2, an electrospray needle apparatus 30 according to the invention is comprised of a capillary needle 32 which has a lumen 34 for passing a liquid therethrough. In the illustrative embodiment, the capillary has an outside diameter of approximately 375 $\mu$m, and an inside lumen diameter within the range of approximately 100–150 $\mu$m. Appropriate dimensions which provide the desired electrospray can be used based on the needs of a particular application. The capillary needle 32 has an outlet 38 at the end of the lumen. A porous bead 40 is disposed at the outlet 38. In this illustrative embodiment, the bead 40 is fabricated of silica using a Sol-Gel process as known in the art. In this illustrative embodiment, beads are utilized/fabricated which have a surface area of approximately 8 $m^2/g$ and pore volume of approximately 2.0 ml/g. Porosity of the illustrative bead(s), i.e. the ratio of pores to solid content, is approximately 0.8. The bead pores have a pore size of approximately 1–3 microns and the beads have a tapped density of approximately 0.22 g/ml. It should be appreciated that generally, the porous bead is fabricated to have a diameter approximately equal to the diameter of the capillary lumen. In the embodiment of FIG. 2, the silica bead 40 has a diameter of approximately 120 $\mu$m and pores of approximately 1–2 $\mu$m.

The tip 42 of the capillary in this embodiment has a detent 44 such as a flange or fillet extending into the lumen to retain the porous silica bead. A taper in the outlet 38 of the capillary 32 allows for the bead 40 to sealingly engage the inside diameter of the capillary lumen 34 to ensure that substantially all of the liquid passing through the tip 42 passes through the pores of the porous bead 40.

Advantageously, the porous silica bead 40 can be plated with gold, such that electrical conductivity is facilitated between the bead and the liquid. The bead can then serve as the anode of the electrospray formation circuit. Similarly, other metals can be used to enhance conductivity of the bead 40.

Figure 3:
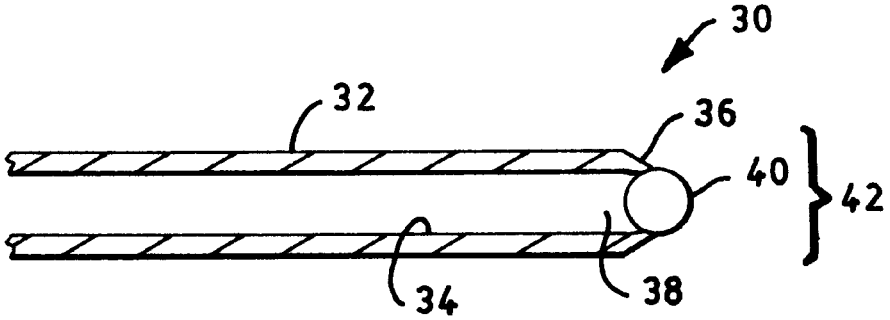
FIG. 3 is an elevation view in cross section of a second embodiment of an illustrative embodiment of the instant invention.

FIG. 3 depicts a second illustrative embodiment according to the present invention. The porous bead 40 may be, for example 120 $\mu$m in diameter, where the inside diameter of the capillary lumen 34 is 100 $\mu$m. In this case, the bead may be attached to the tip of the lumen by glue, fusing, or other conventional methods known in the art, as depicted generally by element 36. In such an embodiment, the bead is more readily accessible, and may even be removably attached to facilitate cleaning or maintenance of the capillary and/or bead.

According to the invention, a needle apparatus for electrospray provides for a capillary having dimensions in excess of the 1–2 $\mu$m orifice typically implemented, such as for nano electrospray. Greater outside diameters of capillaries according to the invention, which can be for example 375 $\mu$m, are more durable and rugged as compared to prior art needles. By providing a porous bead at the tip of the electrospray needle, the outlet of the capillary can be substantially larger than was previously possible. The present invention also provides for a convenient site for the anode of the electrospray formation circuit in the form of the outlet bead plated with gold or other conducting metal.

Although the invention has been shown and described with respect to illustrative embodiments thereof, various changes, additions and omissions in the form and detail thereof may be made therein without departing from the spirit and scope of the invention.

What is claimed is:

1. An electrospray needle comprising:

a capillary having a lumen therethrough and an outlet;

a porous bead engaging said outlet having a plurality of pores through which electrospray passes in exiting said electrospray needle.

2. The electrospray needle of claim 1, wherein said lumen has an inside diameter, and said porous bead has a diameter approximately equal to said inside diameter of said lumen and said porous bead is positioned within said lumen.

3. The electrospray needle of claim 2, wherein said outlet of said capillary further comprises a detent for retaining said bead within said lumen.

4. The electrospray needle of claim 1, wherein said lumen has an inside diameter, and said porous bead has a diameter larger than said inside diameter of said lumen and said porous bead is positioned exterior to said lumen and fastened to said capillary.

5. The electrospray needle of claim 4, wherein said porous bead is bonded to said capillary.

6. The electrospray needle of claim 1, wherein said porous bead is plated in a metal.

7. The electrospray needle of claim 1, wherein said porous bead is plated in gold.

8. A method for forming a fine nebulized spray, comprising the steps of:

providing a capillary having a porous bead at the end thereof; and passing a liquid through said capillary and through said porous bead.

9. The method of claim 8, wherein said fine nebulized spray is an electrospray, and further comprising the step of applying an electrical field to said fine nebulized spray to form said electrospray.

10. The method of claim 9, wherein said step of providing said capillary further comprises providing said porous bead as a gold plated porous bead; and wherein said step of applying said electrical field further comprises utilizing said gold-plated porous bead as an anode.

* * * * *